US006061928A

United States Patent [19]

Nichols

[11] Patent Number: 6,061,928

[45] Date of Patent: May 16, 2000

[54] SHOE HAVING INDEPENDENT PACKED CUSHIONING ELEMENTS

[75] Inventor: Steven B. Nichols, Los Angeles, Calif.

[73] Assignee: K-Swiss Inc., Chatsworth, Calif.

[21] Appl. No.: 08/987,477

[22] Filed: Dec. 9, 1997

[51] Int. Cl.[7] ..... A43B 13/18

[52] U.S. Cl. ..... 36/28; 36/30 A; 36/32 R

[58] Field of Search ..... 36/28, 30 R, 30 A, 36/32 R, 100, 103, 93, 35 R, 88, 141

[56] References Cited

U.S. PATENT DOCUMENTS

| | | | |
|---|---|---|---|
| D. 298,583 | 11/1988 | Yung-Mao . | |
| D. 305,954 | 2/1990 | Kin . | |
| D. 336,977 | 7/1993 | Sensi . | |
| D. 362,956 | 10/1995 | Martin et al. . | |
| D. 373,013 | 8/1996 | Rosetta . | |
| 1,012,597 | 12/1911 | Church . | |
| 1,044,015 | 11/1912 | Byrne . | |
| 1,516,395 | 11/1924 | Miceli . | |
| 1,981,300 | 11/1934 | Berg . | |
| 2,100,492 | 11/1937 | Sindler | 36/28 |
| 2,527,414 | 10/1950 | Hallgren | 36/28 |
| 4,340,626 | 7/1982 | Rudy . | |
| 4,345,387 | 8/1982 | Baswick . | |
| 4,391,048 | 7/1983 | Lutz | 36/30 R |
| 4,593,482 | 6/1986 | Mayer . | |
| 4,598,484 | 7/1986 | Ma . | |
| 4,658,515 | 4/1987 | Oatman . | |
| 4,686,781 | 8/1987 | Bury . | |
| 4,733,483 | 3/1988 | Lin . | |
| 4,750,224 | 6/1988 | Stracke . | |
| 4,782,603 | 11/1988 | Brown | 36/28 |
| 4,823,799 | 4/1989 | Robbins . | |
| 4,841,648 | 6/1989 | Shaffer et al. | 36/43 |
| 4,843,741 | 7/1989 | Yung-Mao . | |
| 4,845,863 | 7/1989 | Yung-Mao . | |
| 4,852,274 | 8/1989 | Wilson | 36/28 |
| 4,881,328 | 11/1989 | Yung-Mao . | |
| 4,887,367 | 12/1989 | Mackness et al. . | |
| 4,896,441 | 1/1990 | Galasso . | |
| 4,905,382 | 3/1990 | Lin . | |
| 4,908,962 | 3/1990 | Yung-Mao . | |
| 4,926,568 | 5/1990 | Coffman | 36/141 |
| 4,970,807 | 11/1990 | Anderie et al. . | |
| 4,972,611 | 11/1990 | Swartz et al. . | |
| 4,999,931 | 3/1991 | Vermeulen . | |
| 5,005,300 | 4/1991 | Diaz et al. | 36/28 |
| 5,092,060 | 3/1992 | Frachey et al. . | |
| 5,117,566 | 6/1992 | Lloyd et al. | 36/30 R |
| 5,233,767 | 8/1993 | Kramer . | |
| 5,381,607 | 1/1995 | Sussmann | 36/30 R |
| 5,383,290 | 1/1995 | Grim . | |
| 5,493,791 | 2/1996 | Kramer . | |
| 5,517,770 | 5/1996 | Martin et al. . | |
| 5,564,202 | 10/1996 | Hoppenstein . | |

*Primary Examiner*—M. D. Patterson
*Attorney, Agent, or Firm*—Oblon, Spivak, McClelland, Maier & Neustadt, P.C.

[57] ABSTRACT

An improved cushioning assembly is provided in which separate, independent cushioning elements are loaded into a pocket of the sole assembly of the shoe. By providing separate and independent cushioning elements, greater variation of the performance of various regions of the shoe can be provided, by utilizing cushioning elements having variations in one or more of their size, shape, orientation, material properties, and amount of precompression. As a result, different regions of the shoe can be better tailored for a particular activity or a particular user. In addition, by providing separate independent cushioning elements, the cushioning elements can be more closely packed as compared with, for example, prior cushioning elements formed as contiguous sheets. With the enhanced ability to more closely pack the cushioning elements, the cushioning elements can better transfer forces laterally, to better absorb and dissipate the forces.

21 Claims, 5 Drawing Sheets

SHOE HAVING INDEPENDENT PACKED CUSHIONING ELEMENTS

BACKGROUND OF THE INVENTION

1. Field of the Invention

The invention relates to shoes, and can be advantageously utilized in athletic shoes in which a plurality of cushioning elements are provided in a sole assembly of the shoe.

2. Discussion of Background

Shoes having cushioning assemblies are well known in a wide variety of forms. For example, cushioning elements have been provided in the form of projections from a contiguous foam sheet, with the projections having various shapes, including semi-spherical projections, convex projections, barrel-shaped projections, etc. The contiguous sheet cushioning assembly is provided as a midsole or sole insert within the shoe.

U.S. Pat. No. 4,345,387 to Daswick discloses an example of a cushioning assembly in which a sheet of cushioning material includes a plurality of rounded projections extending therefrom, with the projections hollow so that they form air pockets to provide a cushioning effect. However, during athletic activities, different regions of the foot are subjected to (and subject the shoe to) different forces and different concentrations of forces, and it can be difficult to accommodate these variations in an interconnected sheet of cushioning elements. Moreover, the force or impact variations not only vary in different regions of the foot for a given activity, but they also vary for different types of activities, as can the fatiguing of cushioning elements among various activities.

Some efforts have been made to accommodate for the variation in forces applied to different regions of a shoe, including providing projections of a contiguous cushioning assembly which have different sizes. However, the ability to vary the cushioning effect utilizing cushioning element size variation alone is limited. For example, it is difficult to form cushioning elements of different hardnesses or material properties where the cushioning elements are joined or formed as part of a single sheet from which the cushioning elements protrude. Moreover, formation of the cushioning elements as an integrated sheet of cushioning elements imposes limitations upon the shapes, variation of shapes, and/or the orientations of a given shape of cushioning element from a manufacturing standpoint. As a result, it is difficult to manufacture a contiguous cushioning assembly or insert for a shoe having the precisely desired variation in hardness/cushioning and support in order to respond to various forces and impacts applied to the shoe and foot.

In addition to the above problems with contiguous sheet cushioning elements most, if not all, conventional cushioning element designs, particularly those of the contiguous sheet variety, are limited in their ability to dissipate energy or impact forces, since the forces are generally absorbed unidirectionally or, in other words, the cushioning elements must absorb the force in the direction in which it is received. In addition, contiguous sheet cushioning assemblies are limited in their ability to provide cushioning elements of a desired density since, as the density of cushioning elements increases, the contiguous sheet becomes more difficult (or impossible) to manufacture, and/or the quality/integrity of each of the respective cushioning elements can be diminished. The limitation upon the density of the cushioning elements limits their ability to effectively transfer forces laterally, i.e, from the location at which the force is received to adjacent cushioning elements and/or to side surfaces of the shoe. Prior cushioning assemblies have also been disadvantageous in requiring separate and complex midsole assemblies, which then must be joined to the outsole to form the sole assembly of the shoe.

Accordingly, improved shoe assemblies, and particularly athletic shoe cushioning assemblies, are constantly under consideration. Particularly needed is a cushioning assembly in which the properties of various portions of the shoe can be tailored to the requirements of the shoe (or wearer) so that shoes can be provided which can accommodate various forces and force concentrations to which the shoe and feet are subjected for various activities and varying needs of the user.

SUMMARY OF INVENTION

Accordingly, it is an object of the invention to provide an improved cushioning assembly for a shoe, in which the assembly is particularly advantageous for an athletic shoe.

It is another object of the invention to provide a cushioning assembly for a shoe which can provide various degrees of cushioning or support in different regions of the shoe to accommodate different forces and different force concentrations which are encountered in a given athletic activity, and with the shoe also modifiable to be suitable for various athletic activities or various user needs.

It is a further object of the invention to provide a shoe which can be conveniently manufactured, while also providing varying degrees of cushioning/support in different regions of the shoe.

It is yet another object of the invention to provide a cushioning assembly for a shoe having a superior ability to absorb or dissipate impact forces by transferring impact forces laterally so that the impact forces are transferred to side walls or side surfaces of the shoe, and preferably to side walls or side surfaces of the sole assembly of the shoe.

The above and other objects and advantages are achieved in accordance with the present invention by providing a plurality of separate cushioning elements which are preferably closely packed within a pocket of the sole assembly of the shoe. In a presently preferred form, the cushioning elements are not attached, or at least are not commonly formed with a contiguous sheet, so that the separate cushioning elements can be formed to have different properties, with the properties of the cushioning elements thus more suitable for a given region of the shoe. The different properties can include one or more of: different sizes of cushioning elements, different hardnesses/elasticities of cushioning elements, different shapes, different packing densities (and different degrees of precompression of cushioning elements), and/or different orientations or packing patterns of cushioning elements. The cushioning elements of the present invention can be formed of polyurethane, however other materials are possible, and it is also possible to utilize different materials or compositions for different cushioning elements of a given shoe. By providing closely packed, separate cushioning elements, when the cushioning elements are subjected to a force, compression of the cushioning elements results in lateral expansion of the cushioning elements and/or a lateral transfer of the force to adjacent cushioning elements, and then to the side walls of the shoe. Alternately, in the case where a single cushioning element extends across the width of the shoe, the lateral transfer of force is directly to the side walls of the sole assembly of the shoe. Further, by providing separate, closely packed cushioning elements within a pocket of the sole assembly of the shoe, the cushioning elements can each be independently formed of sufficient structural integrity. This is in contrast to cushioning elements which are formed as a contiguous sheet, in which the ability to form closely packed protruding cushioning elements is limited, particularly with each having the desired structural integrity and cushioning properties. In addition, the present invention can be advantageous in avoiding the need for an additional midsole cushioning assembly. Of course, if desired, the present invention could also be utilized for improved performance in a sole assembly which additionally includes a midsole assembly.

Other objects and advantages of the present invention will become readily apparent from the various embodiments disclosed herein.

BRIEF DESCRIPTION OF THE DRAWINGS

A more complete appreciation of the invention and many of the attendant advantages thereof will become readily apparent from the following detailed description, particularly when considered in conjunction with the accompanying drawings in which.

DESCRIPTION OF THE PREFERRED EMBODIMENTS

Figure 1A:
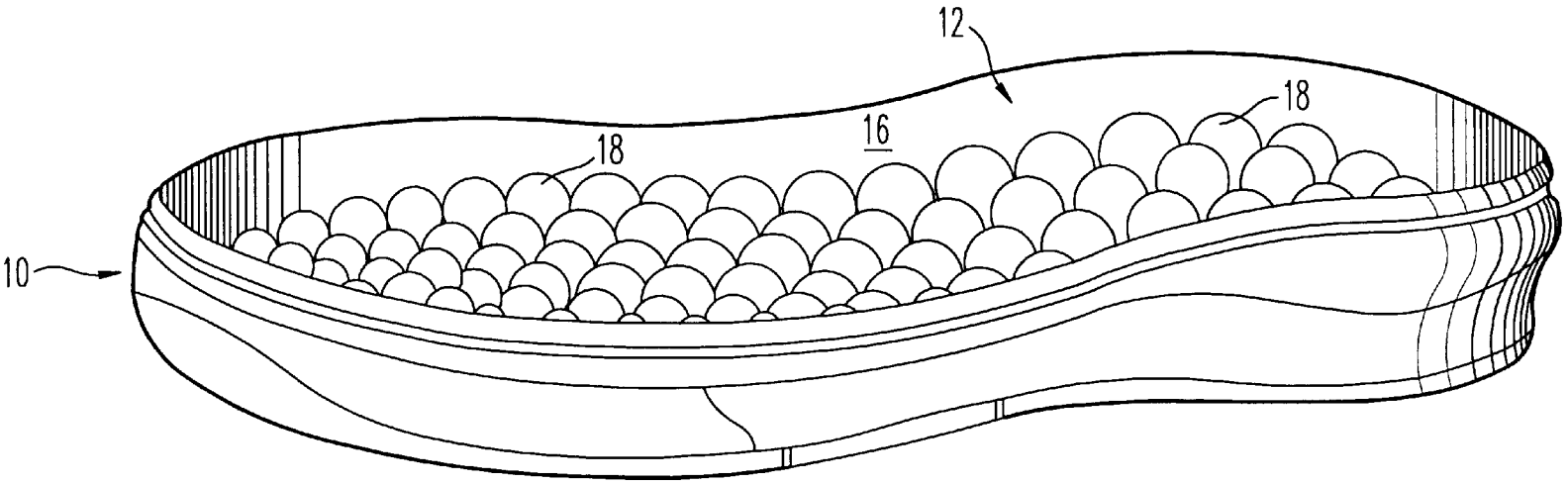
FIGS. 1A and 1B are perspective and side cross-sectional views of a first embodiment of the invention.
Figure 1B:
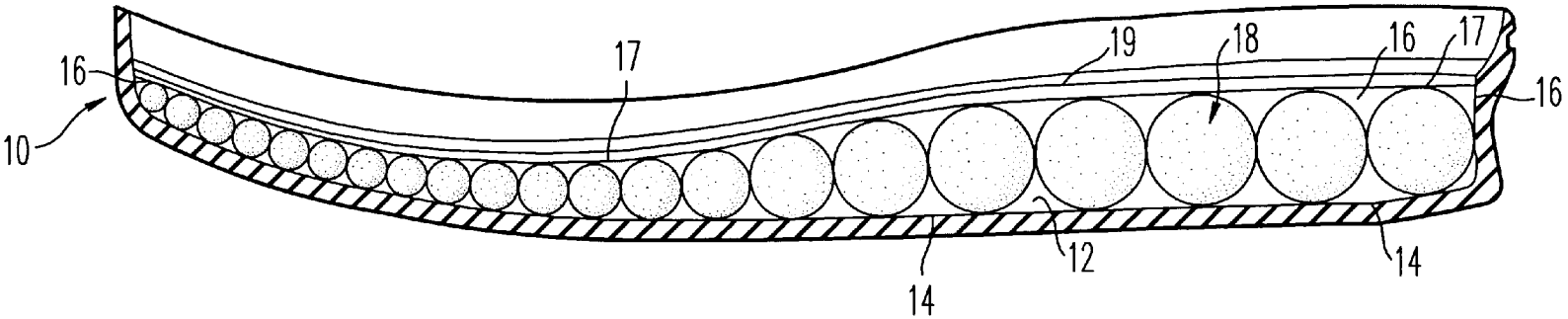

Referring now to the drawings, wherein like reference numerals designate corresponding parts throughout the several views, FIGS. 1A and 1B depict a first embodiment of the present invention in which the cushioning elements are provided in the form of independent spheres 18. In the embodiment of FIGS. 1A and 1B, a sole assembly 10 is provided, with the sole assembly defining an internal pocket 12. Although the pockets of the presently preferred embodiments disclosed herein are provided in an outsole or outsole component, it is to be understood that the present invention could also be applied to a pocket formed in a midsole component of a sole assembly.

The pocket 12 is defined by a bottom surface 14 and side surfaces 16 extending about the periphery of the pocket. Within the pocket 12, a plurality of spherical cushioning elements 18 are provided, each of which is in the form of a sphere. By providing plural independent or separate cushioning elements 18, the cushioning elements can be closely packed within the sole assembly, so that the cushioning elements contact each other at their "equators." Further, by providing the cushioning elements as separate or independent cushioning elements, they can be formed to have different properties, including different sizes and different hardnesses or elasticities, while each cushioning element can be formed of sufficient quality and structural integrity. As discussed earlier, it can be extremely difficult to form closely packed cushioning elements with prior contiguous sheet arrangements in which the cushioning elements protrude from the sheet, and the properties of the contiguous sheet protrusions cannot vary as greatly as compared with the present invention. With the closely packed arrangement, the cushioning elements support one another, thereby limiting excess deformation of the cushioning elements. Where concentrated or large forces are applied to a given cushioning element or a given region of cushioning elements of the invention, the tendency of that cushioning element or those cushioning elements to expand laterally transfers the forces to adjacent cushioning elements, and ultimately to the side surfaces 16 of the sole assembly 10.

Thus, in addition to providing the ability to vary the properties of cushioning elements in different regions of the shoe, the closely packed independent cushioning elements are advantageous in better transferring forces laterally so that they are ultimately received by the side surfaces of the shoe. By contrast, with most, if not all, cushioning elements provided in the form of a contiguous sheet, forces must primarily be absorbed unidirectionally, i.e., in the direction in which the force is received.

A layer of material 17 (e.g., a fabric, foam, or another natural or resin material) is laid over the cushioning elements so that the pocket 12 and material 17 provide a container or enclosure for the cushioning elements. In the presently preferred form of the embodiments of the present invention, the cushioning elements need not be adhered or fastened to surfaces within the pocket or the layer 17, and it is preferable to minimize or provide no fastening of the cushioning elements so that the cushioning elements are able to more freely transfer forces laterally. However, if desired, the cushioning elements could be fastened, e.g., with an adhesive, to each other, to the pocket 12, and/or to the layer 17, to prevent excessive movement or dislocation of the cushioning elements. For example, the cushioning elements could be adhered to each other, with peripheral elements adhered to the side surfaces of the pocket 12. The cushioning elements could also be provided in seats or depressions in the bottom surface 14 of the pocket 12 to further assist in maintaining a desired position of the elements. Even where the cushioning elements are fastened in place, since they are independently formed and then loaded into the pocket, they nevertheless are able to provide greater tailoring of the properties of various regions of the shoe and, since they can be closely packed, better lateral transfer of forces is achieved as compared with prior arrangements (such as contiguous cushioning sheets). The layer 17 can be stitched or otherwise fastened to the sole assembly 10. An insole 19 (or, if desired, a further cushioning assembly) can be disposed over the layer 17.

The embodiment of FIGS. 1A and 1B advantageously utilizes the properties of spheres, which are desirable in that the lateral expansion of the spheres can occur about substantially the entire 360° periphery of the spheres. In addition, the more a given sphere is compressed, the more difficult it becomes to further compress the sphere and thus, as the sphere becomes flatter it becomes more supportive. As shown in FIG. 1B, the spheres can be formed of different sizes, and are closely packed so that they touch each other at their equators. In addition, spheres having different material properties can be utilized so that each region of the shoe performs more optimally. Different packing patterns can also be utilized (e.g., aligned rows, staggered rows, etc.) to further allow the cushioning assembly to be optimally tailored.

One shortcoming with spheres is that it can be difficult to mass produce spherical cushioning elements economically. The arrangement of FIGS. 2A and 2B thus provides plural independent or separate cushioning elements in the form of cylindrical cushioning elements 20. The cylindrical cushioning elements 20 can be formed more economically, in that they can be simply extruded and then cut to desired lengths, or they can be extruded as small segments. Thus, cylindrical segments can generally be formed more readily than spheres. However, like the spherical cushioning element embodiment, the individualized cushioning elements 20 can be closely packed within the pocket 12 of the sole assembly 10, so that forces absorbed by the cushioning elements are transferred laterally, and ultimately to the side wall surfaces 16 of the sole assembly 10. In addition, like the spherical cushioning elements, the cylindrical cushioning elements 20 can be formed to have different properties, including different sizes (diameters), and/or different hardness or elastic properties. The cylindrical cushioning elements 20 can be further varied in that, for a given diameter of the cushioning elements 20, different cushioning element lengths can be utilized.

Figure 2A:
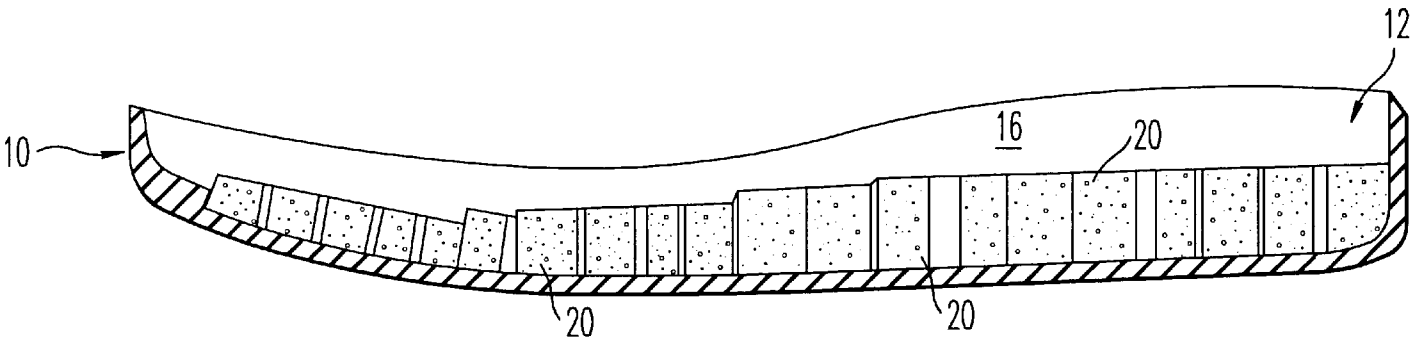
FIGS. 2A and 2B are side cross-sectional and top views of an alternate embodiment of the present invention.

As shown in FIG. 2A, taller cushioning elements can be utilized, for example, in the heel region of the shoe, while shorter cushioning elements can be provided in the forefoot region. In addition, if desired, taller cushioning elements can be provided in an arch or instep region of the shoe, and the cushioning elements in the inner arch region can be taller as compared with the outer arch region of the shoe (i.e., the cushioning elements in the arch region can be taller adjacent to the inner lateral side wall 16*a* of the shoe, with the heights becoming progressively shorter toward the outer lateral side surface 166 of the sole assembly). The bottom surface 14 of the pocket 12 can also be contoured so that for a given combined height of the sole component 10 and cushioning elements, cushioning elements of different heights can be provided. (In other words, the combined sole and cushioning element height can provide the desired contour for the foot, while the cushioning element height can be varied to vary the amount of cushioning.) As discussed earlier, in addition to the ability to provide closely packed independent cylindrical cushioning elements having the same or different diameters and the same of different heights, different material properties can be provided among the different cushioning elements so that they have different hardnesses or elastic properties. Needless to say, with these variations available and made possible by the use of separate and independent cushioning elements which are closely packed within a pocket of the shoe, the cushioning assembly can be tailored to accommodate different forces encountered across the shoe assembly for a given activity, and to accommodate different forces which are encountered in different athletic activities.

Figure 2B:
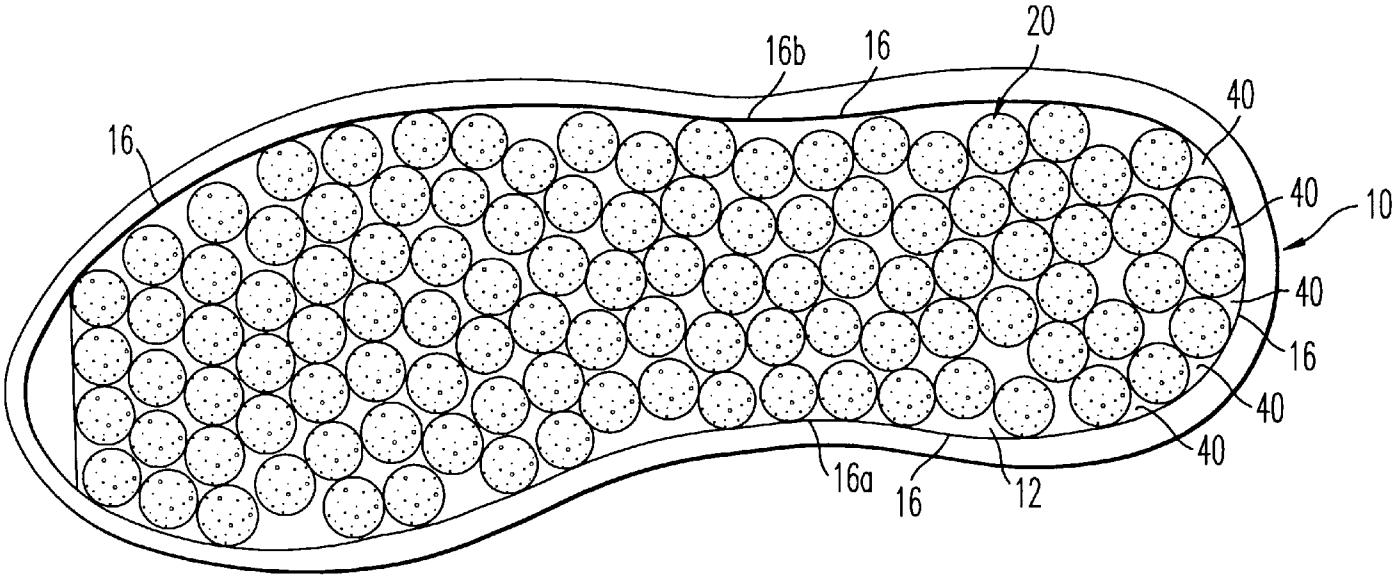
Figures 3A, 3B, 3C:
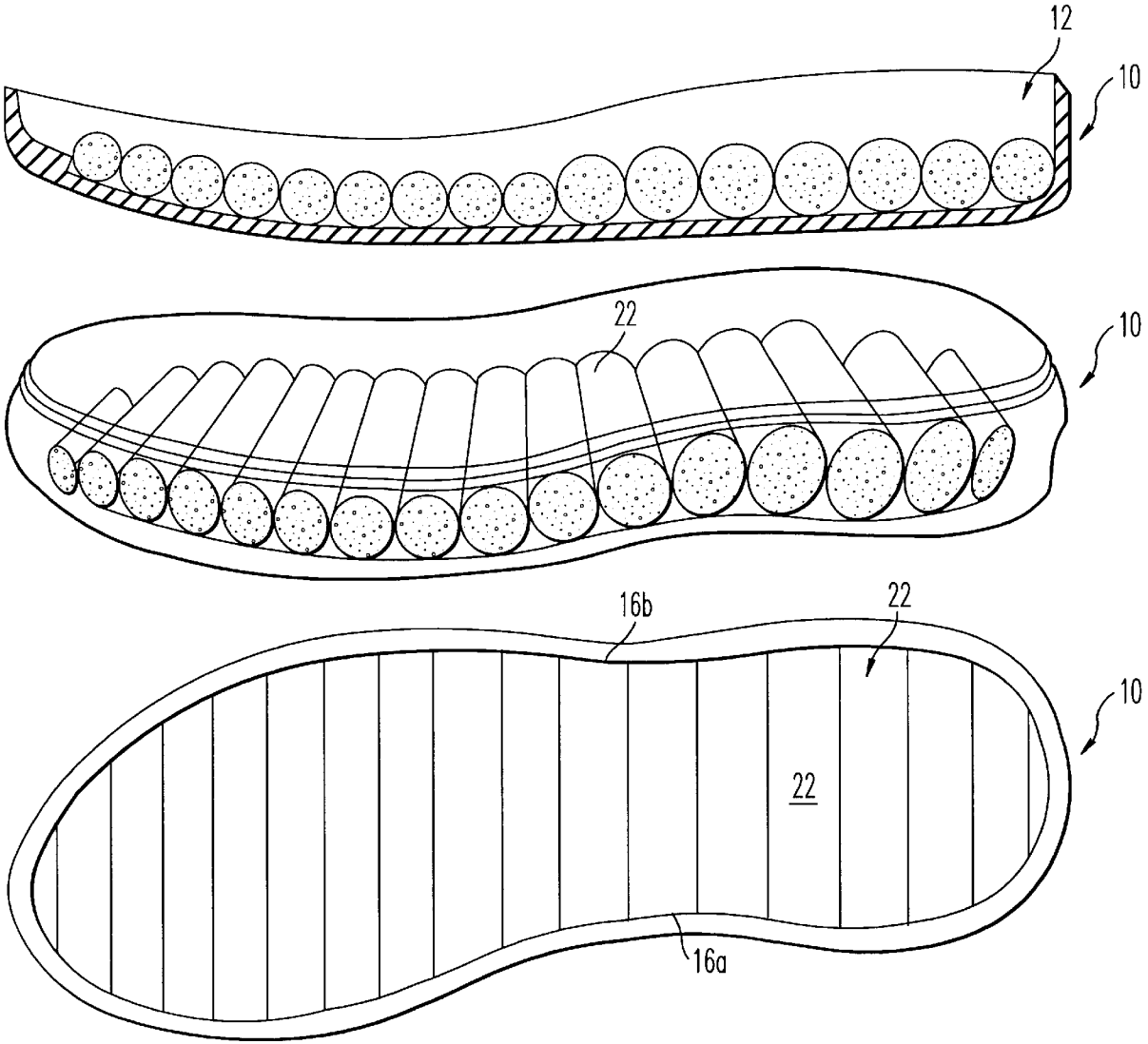
FIGS. 3A–3C are side, perspective, and top views of another embodiment of the present invention.

FIGS. 3A–3C depict yet another variation made possible by the separate, closely packed cushioning elements utilized in accordance with the present invention. In particular, as demonstrated by FIGS. 3A–3C, an additional variation made possible by the present invention is that the cushioning elements can be oriented differently. More particularly, the cushioning elements of FIGS. 3A–3C include cylindrical cushioning elements 22, however the cylindrical elements 22 are disposed horizontally as compared with the vertical cylinders of FIGS. 2A and 2B. As with the other embodiments disclosed herein, the cylinders 22 can be formed separately and then loaded into the pocket 12. In the embodiment of FIGS. 3A–3C, the cushioning elements 22 extend from an inner side surface 16*a* of the pocket 12 to the outer side surface 16*b* of the pocket 12. However, if desired, cylinders of shorter lengths can be utilized, so that they do not traverse the full lateral width of the shoe. In any case, the horizontally disposed cushioning elements can be advantageously utilized in that they can more readily transfer forces laterally, so that the forces are transferred to the side wall surfaces 16*a*, 16*b* of the sole assembly 10 of the shoe. As with the other embodiments, not only are different sizes (cylinder diameters and/or cylinder lengths) of cushioning elements possible in the embodiment of FIGS. 3A–3C, but also, the cushioning elements can be formed to have different material properties.

Figure 5:
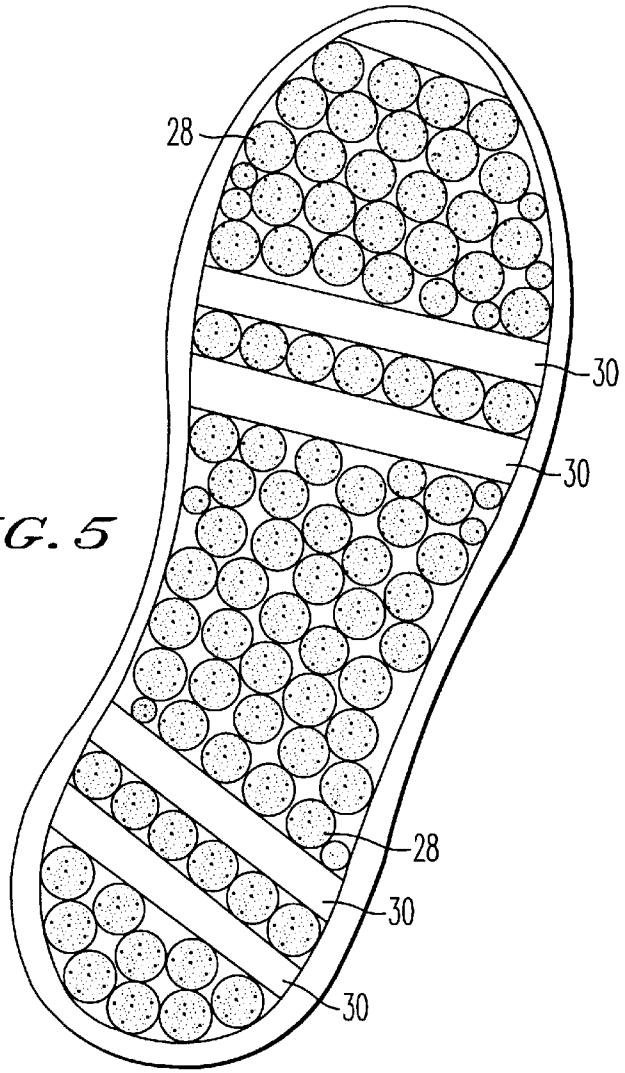
FIGS. 4 and 5 depict top views of further alternative embodiments of the present invention.
Figure 4:
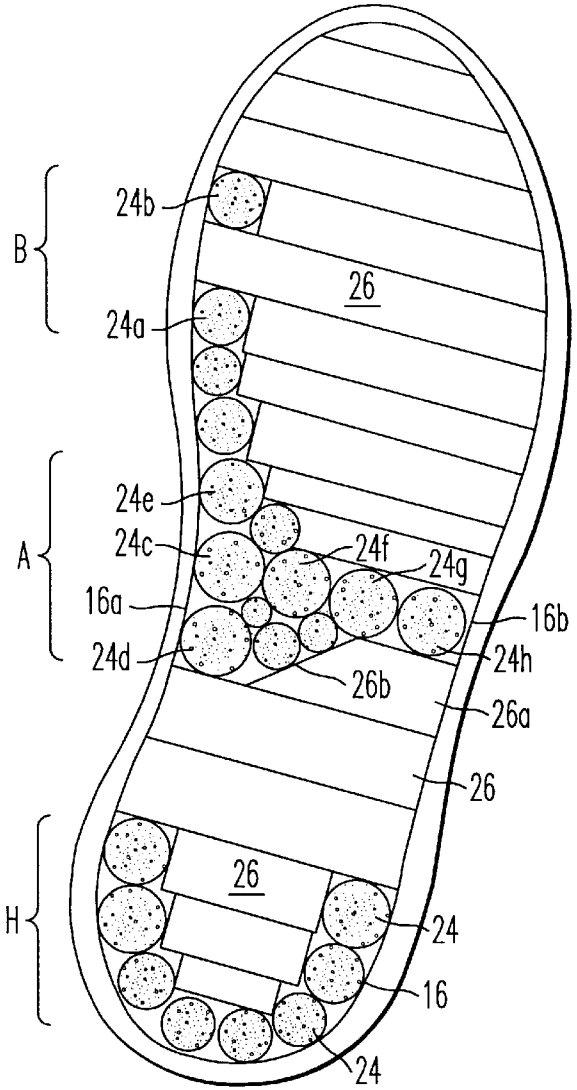

FIGS. 4 and 5 depict further variations which are possible in accordance with the present invention. In particular, in the embodiments of FIGS. 4 and 5, cylindrical cushioning elements are provided, with the cushioning elements including closely packed cylinders which not only have different sizes, but which also are oriented differently. More particularly, in the embodiments of FIGS. 4 and 5, some of the cushioning elements are vertical while others are horizontal. If desired, cushioning elements of different shapes could also be utilized in a given assembly, for example, by providing a combination of spheres and cylinders.

In the FIG. 4 embodiment, vertical cushioning elements 24 can be provided where greater support is needed, or where it is desired to limit the cushioning or expansion of other cushioning elements. For example, in the heel region H of the shoe of FIG. 4, cushioning elements 24 are provided adjacent the side surfaces 16 of the pocket 12 of the sole assembly 10, and about the periphery of the heel region. Horizontal cylindrical elements 26 are disposed interiorly of the vertical cushioning elements 24 in the heel region. With this arrangement, the vertical cushioning elements 24 in the heel region can provide support, and can also prevent excessive elongation (and thus inadequate support) of the horizontal cushioning elements 26 in the heel region. Thus, this combination can be advantageous in that the vertically disposed cylinders tend to be more supportive, while the horizontal cushioning elements tend to deform more easily, but also tend to laterally transfer forces more readily. Thus, when the heel region of the shoe is subjected to a force, the cushioning elements 26 will initially begin compressing more easily, and then the heel region becomes supported and cushioned by the peripheral vertical cylinders 24. Thus, excessive flattening of the horizontal cylinders 26 is prevented (which excessive flattening can be undesirable in that, when cushioning elements become excessively deformed, they provide little or no cushioning at all) and an advantageous combination of cushioning element orientations is provided.

Similarly, in the forefoot or ball region of the foot indicated generally at B, cylindrical cushioning elements 24*a*, 24*b* can be provided in the frontal and rear regions of the ball of the foot, for improved support of the ball of the foot. In the embodiment shown in FIG. 4, the cushioning elements 24*a*, 24*b* provide additional support so that the lowermost portion of the ball of the foot does not excessively deform the horizontal cylindrical cushioning element 26, to thereby prevent bruising or injury to the ball region of the foot.

In the arch region of the foot (at which superior support is desired, but which is not generally required to have superior elasticity or cushioning), vertical cylindrical cushioning elements can be provided. In a presently preferred form of the invention shown in FIG. 4, cushioning elements disposed adjacent to the interior side surface 16*a* of the shoe will have a greater height as compared with those adjacent the outer side surface 16*b*. In addition, the cushioning elements extending along the interior region of the arch can have different heights. For example, the cushioning element 24*c* can have a height which is greater than that of the cushioning elements 24*d* and 24*e*. Similarly, the cushioning element 24*c* can have a height which is greater than that of the cushioning element 24*f*, while the cushioning elements 24*g* and 24*h* can have even shorter heights. Obviously, a wide variety of constructions and cushioning/support properties are made possible by the present invention, by providing independent cushioning elements which are closely packed, since the cushioning elements can be formed of different sizes, shapes, orientations, and material properties. Although the cushioning elements depicted are generally right circular cylinders in the FIG. 4 embodiment, a cylinder 26*a* can be provided having an inclined surface 26*b* so that the cylinder is a non-right circular cylinder, to provide a better transition between horizontally and vertically disposed cylinders, for example, in the arch region of the shoe.

As the number of variations of cushioning elements for a given shoe increases, the shoe becomes more complicated to assemble. To ensure proper placement of the cushioning elements, a code or grid (either a printed grid of corresponding cushioning element shapes, or indentations corresponding to the cushioning element sizes/shapes/orientations) can be provided in the bottom of the sole pocket, to assist in properly positioning elements of different sizes, shapes, orientations, etc. For further variations, for example, where the material properties are varied, a color coded grid or pattern can be printed within the pocket of the sole assembly, and the cushioning elements can be formed of or marked with that respective color so that the cushioning elements can be properly located within the pocket by matching the color on the cushioning element with the corresponding color within the pocket. Of course, various other codes, such as alphanumeric codes, could also be utilized. Thus, the separate cushioning elements can be readily loaded into their desired position, even if a number of different cushioning elements or cushioning element orientations are utilized. It is to be understood that the cushioning elements can be loaded manually or automatically.

FIG. 5 depicts yet another variation, in which the cushioning assembly is formed primarily of vertical cylindrical cushioning elements 28, which tend to provide improved support. However, horizontally disposed cushioning elements 30 are also provided in heel and forefoot regions of the shoe for improved cushioning and more efficient transference of forces to the side surfaces of the shoe.

FIGS. 6A–6E depict examples of further geometric arrangements. As shown, the separate cushioning elements can have various geometric shapes, including polyhedrons or prisms having triangular (three-sided) cross-sections or polyhedrons having rectangular/square cross-sections. Of course, various other geometric shapes are also possible. As with the earlier embodiments, the cushioning elements can be of different sizes and/or formed of different materials. In addition, the cushioning elements can be disposed at different orientations in different locations of the shoe.

Figure 6A:
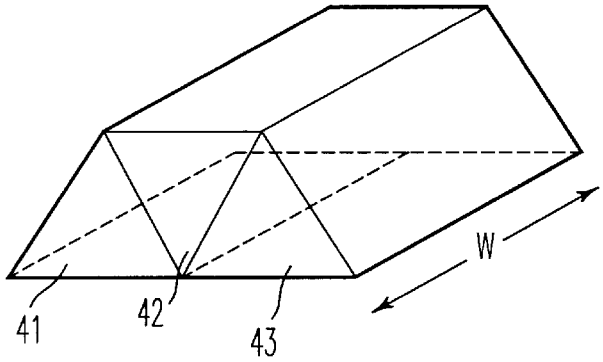
FIGS. 6A–E depict additional cushioning element configurations and orientations which can be utilized in accordance with the present invention.

FIG. 6A depicts cushioning elements which are triangular in cross-section, and which are disposed in an alternating up-and-down configuration for a snug fit. The cushioning elements can be disposed to extend along the width direction (represented by arrow W in FIG. 6A) of the shoe, along the length of the shoe, or at an angle between the length and width directions. Of course, the triangular cushioning elements can also be disposed so that when viewed in plan view (i.e., looking down into the sole of the shoe) the triangular end face appears, or in other words, the triangular elements can be disposed perpendicular to the orientation of FIG. 6A. In addition, various combinations of orientations are possible, and the triangular cushioning elements can also be utilized in combination with other shapes in a given sole structure. By way of example, a triangular prism cushioning element can be disposed, for example, in the spaces 40 about the periphery of a shoe as shown in FIG. 2B, so that the triangular cushioning elements (i.e., which would appear triangular in the plan view of FIG. 2B) provide a peripheral support and assist in positioning of other cushioning elements having different shapes (e.g., cylindrical or spherical cushioning elements).

Referring again to FIG. 6A, the triangular cushioning elements can be disposed so that the apex of alternating elements is reversed. As shown in FIG. 6A, elements 41, 43 have their apices pointing up, while the apex of element 42 points down. In regions of the shoe where greater cushioning is desired, it is also possible to eliminate the alternating arrangement, for example, so that only the elements 41 and 43 are present (or, alternatively, only downwardly facing cushioning elements 42 are provided), while in other regions where greater support is required, the alternating structure as shown in FIG. 6A can be provided. In addition, while the elements 41–43 of FIG. 6A are of substantially the same size, the elements can have different sizes. For example, the downwardly facing elements 42 can be smaller than that of the upward elements 41, 43, so that upon initial compression greater cushioning is provided as the tips or apices of elements 41, 43 are deflected, and then the foot will encounter the base of element 42 to provide greater support and prevent excessive compression.

Figure 6B:
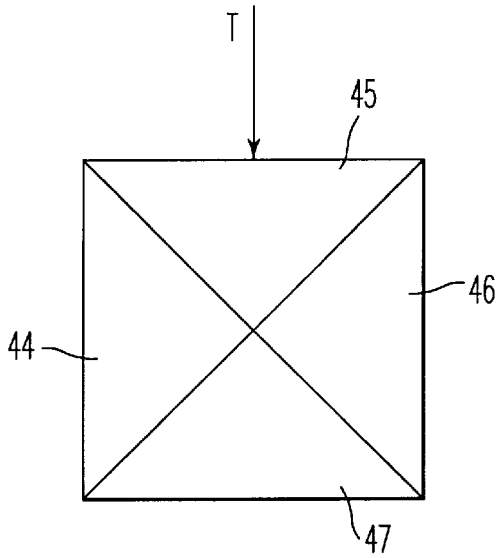

FIG. 6B is an end view of an alternate arrangement of triangular prism cushioning elements. In this arrangement, the apices of the triangular elements 44–47 face one another, so that, in combination, the triangular elements form a rectangular/square polyhedron. However, the arrangement of FIG. 6B provides further advantages as compared with a simple rectangular/square polyhedron, in that the different cushioning elements can be formed of different materials, i.e., having different hardnesses or elasticities. For example, the cushioning elements 44, 46 can be formed as softer or harder cushioning elements as compared with those at 45, 47, to provide the desired overall cushioning effect or strength versus deflection profile as a force (indicated by arrow F) is applied to the cushioning elements. FIG. 6B depicts an end view of cushioning elements which can be disposed to extend along the width of the shoe (i.e., the width of the shoe would be into and out of the page in FIG. 6B), however it is to be understood that alternate orientations are also possible.

Figure 6C:
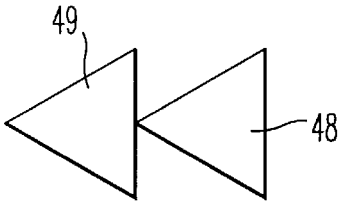

FIG. 6C depicts yet a further orientation which can be suitable for providing triangular prism cushioning elements which have a triangular profile when viewed in plan view (i.e., when looking down into the shoe, the triangular profile would appear as shown in FIG. 6C, and the cushioning elements extend perpendicular to the sole of the shoe). The arrangement of FIG. 6C can be suitable, for example, in peripheral areas of a shoe to readily accommodate smaller amounts of lateral expansion, while providing a limiting effect of the transverse expansion of other cushioning elements (which may be triangular or other shapes) disposed in other regions of the shoe. With the tip of one cushioning element 48 extending to the base of another triangular cushioning element 49, the tip will initially deform with relative ease, thus permitting further expansion of other cushioning elements disposed adjacent to element 48), while as the tip is deformed more greatly, it is more resistant to further deformation, to thereby limit excessive deflection of the cushioning element 48 and also to limit excessive expansion/deflection of cushioning elements disposed adjacent to element 48.

Figure 6D:
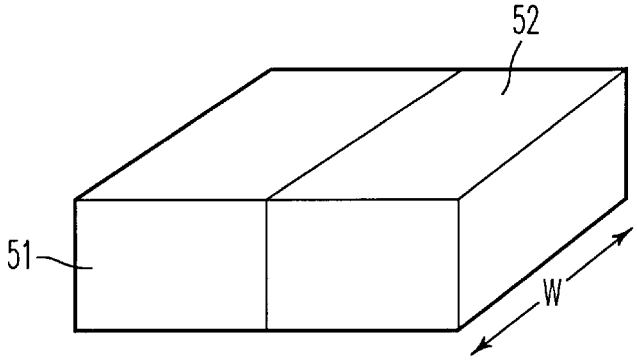
Figure 6E:
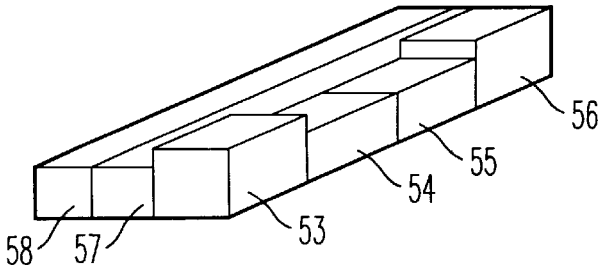

FIGS. 6D and 6E depict rectangular/square prism arrangements. As shown in FIG. 6D, adjacent separate rectangular prism cushioning elements 51, 52 can be disposed adjacent to each other, to extend along the width direction W of the shoe. Of course, in certain areas of the shoe, the cushioning elements can also extend in the length direction, or perpendicular to the width and length directions of the sole, and different orientations can be utilized in a given sole and can also be utilized in combination with cushioning elements of different shapes.

FIG. 6E shows a further variation in the use of polyhedron cushioning elements, in which shorter length elements are utilized in a given area to form a row of elements having a different height, while in other areas, longer constant height polyhedrons are provided. The arrangement of FIG. 6E can be utilized to further enhance the ability to provide varying cushioning effects and varying amounts of support in different regions of the shoe. For example, the arrangement of FIG. 6E can be utilized as a portion of the sole region of the shoe, in which the heel of the foot begins to taper. For example, the elements 53 and 56 can be provided of a given height, while the elements 54, 55 therebetween are somewhat shorter, so that a gap is provided between the elements 53, 56. Thus, the elements 53, 56 can provide support for the rear peripheral portions of a heel, and a row of cushioning elements behind the row 53–56 can each be taller but have a narrower gap between the tallest elements of the row (corresponding to elements 53, 56) so that the gap tapers and narrows as the rear portion of a heel narrows. In front of the row 53–56, longitudinally or width-wise elements 57, 58 can be provided, and if desired, in front of these cushioning elements, a row as shown at 53–56 can be provided, to thereby conform to the front contour of the heel portion of the foot. Of course, the arrangements of FIGS. 6A–E are provided as examples, in order to demonstrate the additional variations which are possible with the present invention.

Yet another variation made possible by the present invention is that the cushioning elements can be closely packed to the extent that they are in a precompressed state when loaded into the shoe, and if desired, different degrees of precompression can be provided in different regions of the shoe. For example, where the cushioning elements are cylinders, in an uncompressed state, adjacent cylinders (as shown, e.g., in FIG. 3C), will contact one another along essentially a line of contact or, in the case of uncompressed spheres (or cylinders which are perpendicular to each other), a point contact will be provided. If desired, the cushioning elements (or certain regions of cushioning elements) can be packed so that even with cylindrical or spherical cushioning elements, they are laterally precompressed, so that planar contact surfaces are provided between adjacent cushioning elements. Differing degrees of precompression can thus also be utilized to vary the cushion/support performance of the cushioning elements.

Obviously, by providing the separate independent cushioning elements of the present invention, numerous variations are now possible, so that a shoe can be tailored to the forces encountered in a particular activity, and so that different variations can be utilized to make shoes more particularly suited for a given activity. In addition, variations can be provided to accommodate a particular user's needs, for example, if the user has sustained or is susceptible to an injury in a particular region of the foot, ankle or leg.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A shoe comprising:

a sole assembly, said sole assembly having at least one pocket therein, said at least one pocket having a bottom surface and side surfaces inside of said pocket;

a plurality of separately formed cylindrical cushioning elements disposed in said at least one pocket, wherein adjacent cushioning elements are in contact with each other such that when a force is applied to a top of said cushioning elements said cushioning elements are deformed between said bottom surface of said pocket and said top of said cushioning elements, and wherein said cushioning elements are expandable in a lateral direction, such that upon application of said force said cushioning elements transfer said force to said side surfaces of said pocket:

wherein said plurality of cylindrical cushioning elements have a cylindrical shape in an uncompressed state, and wherein at least some of said cushioning elements are disposed in said pocket under compression such that adjacent cushioning elements are compressed and deformed against each other and a planar contact surface is provided between adjacent contacting cushioning elements.

2. A shoe as recited in claim 1, wherein said plurality of cylindrical cushioning elements include cylindrical cushioning elements which extend in said lateral direction.

3. A shoe as recited in claim 1, wherein said plurality of cylindrical cushioning elements include cylindrical cushioning elements which extend in a direction perpendicular to said lateral direction.

4. A shoe as recited in claim 1, wherein said plurality of cylindrical cushioning elements include a first plurality of cylindrical cushioning elements extending in a first direction and a second plurality of cylindrical cushioning elements extending in a second direction, and wherein said second direction is perpendicular to said first direction.

5. A shoe as recited in claim 4, wherein at least one row of said plurality of cylindrical cushioning elements is provided which includes at least one of said first plurality of cylindrical cushioning elements and at least one of said second plurality of cylindrical cushioning elements, and further wherein said row extends substantially in said lateral direction.

6. A shoe as recited in claim 5, wherein said side surfaces include a first side surface and a second side surface, with said first and second side surfaces each extending in a direction from a heel region of said shoe toward a toe region of said shoe, and wherein said lateral direction extends in a direction from said first side surface toward said second side surface.

7. A shoe as recited in claim 4, wherein a heel region of said shoe includes some of said first plurality of cylindrical cushioning elements disposed at a periphery of said heel region and adjacent to the side surfaces of said pocket in said heel region, and wherein some of said second plurality of cylindrical cushioning elements are disposed in said heel region interiorly of said some of said first plurality of cylindrical cushioning elements.

8. A shoe as recited in claim 4, wherein at least some of said first plurality of cylindrical cushioning elements is disposed in an arch region of said shoe, and wherein said first direction is perpendicular to said lateral direction.

9. A shoe as recited in claim 8, wherein said at least some of said first plurality of cylindrical cushioning elements have different heights.

10. A shoe as recited in claim 9, wherein one of said second plurality of cylindrical cushioning elements is disposed adjacent to said at least some of said first plurality of cylindrical cushioning elements disposed in said arch region, and wherein said one of said second plurality includes an inclined end surface such that said one is a non-right circular cylinder cushioning element.

11. A shoe as recited in claim 1, wherein at least one of said plurality of cylindrical cushioning elements has an inclined end surface such that said at least one is a non-right circular cylinder cushioning element.

12. A shoe as recited in claim 1, wherein a layer of material is disposed over said plurality of cushioning elements such that said layer of material is in contact with said plurality of cushioning elements.

13. A shoe as recited in claim 12, wherein said plurality of cushioning elements are not fastened to said layer of material.

14. A shoe as recited in claim 12, wherein said layer of material is stitched to said sole assembly.

15. A shoe as recited in claim 12, wherein an insole of said shoe is disposed over said layer of material.

16. A shoe as recited in claim 1, wherein at least one of said sole assembly and said plurality of cylindrical cushioning elements includes a code for indicating a position of said plurality of cylindrical cushioning elements with respect to said sole assembly to assist in positioning said plurality of cylindrical cushioning elements with respect to said sole assembly during assembly of said shoe.

17. A shoe as recited in claim 1, wherein said plurality of cylindrical cushioning elements have a plurality of different hardnesses.

18. A shoe as recited in claim 1, wherein said plurality of cylindrical cushioning elements are formed of different materials.

19. A shoe assembly as recited in claim 1, wherein said plurality of cylindrical cushioning elements are disposed in different orientations.

20. A shoe assembly as recited in claim 1, wherein said plurality of cylindrical cushioning elements include at least one of: (a) a plurality of horizontal cylindrical cushioning elements having different diameters, and (b) a plurality of vertical cylindrical cushioning elements having different diameters.

21. A shoe assembly as recited in claim 20, wherein said plurality of cushioning elements have a plurality of different hardnesses.

* * * * *